US009874894B2

(12) United States Patent
Onishi

(10) Patent No.: US 9,874,894 B2
(45) Date of Patent: Jan. 23, 2018

(54) TEMPERATURE STABLE REFERENCE CURRENT

(71) Applicant: SEMICONDUCTOR COMPONENTS INDUSTRIES, LLC, Phoenix, AZ (US)

(72) Inventor: Akinobu Onishi, Ota (JP)

(73) Assignee: SEMICONDUCTOR COMPONENTS INDUSTRIES, LLC, Phoenix, AZ (US)

( * ) Notice: Subject to any disclaimer, the term of this patent is extended or adjusted under 35 U.S.C. 154(b) by 31 days.

(21) Appl. No.: 14/936,927

(22) Filed: Nov. 10, 2015

(65) Prior Publication Data

US 2017/0017253 A1 Jan. 19, 2017

Related U.S. Application Data

(60) Provisional application No. 62/193,462, filed on Jul. 16, 2015.

(51) Int. Cl.
*G05F 3/26* (2006.01)

(52) U.S. Cl.
CPC ..... *G05F 3/262* (2013.01)

(58) Field of Classification Search
CPC ..... G05F 3/02; G05F 3/08; G05F 3/10; G05F 3/16; G05F 3/20; G05F 3/24; G05F 3/26; G05F 3/262
See application file for complete search history.

(56) References Cited

U.S. PATENT DOCUMENTS 6,897,717 B1 * 5/2005 Eddleman ..... G05F 3/262 327/108
6,930,538 B2 * 8/2005 Chatal ..... G05F 3/267 327/513
7,304,466 B1 * 12/2007 Kimura ..... G05F 3/245 323/313
2010/0052645 A1 * 3/2010 Huang ..... G05F 3/262 323/315

FOREIGN PATENT DOCUMENTS

JP 2005-228160 A 8/2005
JP 2005-301410 A 10/2005

* cited by examiner

*Primary Examiner* — Gary L Laxton
(74) *Attorney, Agent, or Firm* — Polansky & Associates, P.L.L.C.; Paul J. Polanksy

(57) ABSTRACT

A circuit for generating a constant current includes a first current generator that conducts a first current based upon a supply voltage and a resistive element and that generates a first mirrored current based on the current, a second current generator that generates a second current based on the first current wherein the second mirrored current decreases as the current increases and decreases as the current increases and a summing circuit for summing currents proportional to said first and second currents to generate an output current.

17 Claims, 8 Drawing Sheets

TEMPERATURE STABLE REFERENCE CURRENT

CROSS REFERENCE TO RELATED APPLICATIONS

This application claims priority to U.S. Provisional Application No. 62,193,462, filed on Jul. 16, 2015, entitled "Temperature Stable Reference Current," invented by Akinobu Onishi.

FIELD OF THE DISCLOSURE

The present disclosure relates generally to biasing circuits and, more particularly, to reference current sources.

BACKGROUND

The following description of the Background is intended provided to provide helpful information and is not considered by the Applicant to be admitted prior art. Some of the observations discussed may well be observations made contemporaneously with the conceptual developments of the inventive concepts and are not admitted to being known by those of average skill in the art.

Constant reference currents that remain substantially constant despite changes in device temperature and loading are needed. In many reference current generation circuits that include resistive elements and MOSFET transistors, reference currents fluctuate with temperature changes. Current often increases with temperature. Accordingly, current consumption increases for circuitry whose operations are based on the reference currents. Such increases in current consumption lead to increases in power consumption and, for portable electronics, a decrease in battery life. It is desirable, therefore, to develop reference current sources that operate substantially independent of temperature changes and loading conditions.

In addition, not only do temperature dependent current increases undesirably power consumption and decrease battery life, increases in reference currents can also degrade performance of analog circuits. This result occurs because the changed reference currents may change the bias conditions for analog circuitry and therefore their operating characteristics. While there are circuits that utilize trimming or calibration technology, such solutions are expensive in terms of IC real estate and associated power consumption. Accordingly, a need exists for stable reference current sources that fluctuate less due to temperature increases.

BRIEF DESCRIPTION OF THE DRAWINGS

The present disclosure may be better understood, and its numerous features and advantages made apparent to those skilled in the art by referencing the accompanying drawings, in which.

The use of the same reference symbols in different drawings indicates similar or identical items. Unless otherwise noted, the word "coupled" and its associated verb forms include both direct connection and indirect electrical connection by means known in the art, and unless otherwise noted any description of direct connection implies alternate embodiments using suitable forms of indirect electrical connection as well.

DETAILED DESCRIPTION

Figure 1:
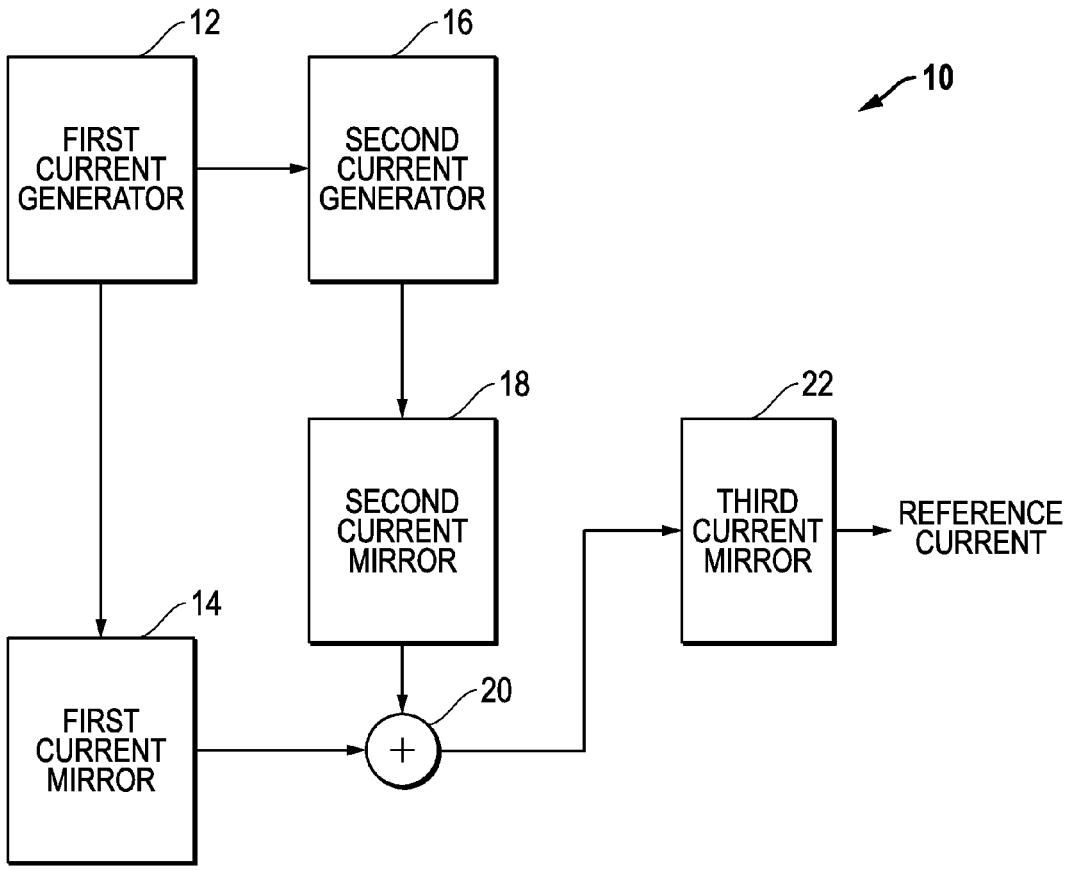
FIG. 1 is a block diagram of a system for generating a constant reference current according to an embodiment.

FIG. 1 is a block diagram of a system for generating a constant reference current according to an embodiment. The system 10 of FIG. 1 comprises a first current generator 12 configured to generate a first current. In one embodiment, the first current generator 12 generates the first current based upon a resistive element value in relation to a supply voltage. A first current mirror 14 generates a first mirrored current based on the first current generated by the first current generator. A current mirror is a circuit designed to copy a current through one active device by controlling the current in another active device of a circuit, keeping the output current constant regardless of loading. A current mirror configuration results in an active device generating a current based on a reference current. In the embodiment of FIG. 1, the reference current that is mirrored by the first current mirror 14 is the first current generated by the first current generator 12.

A second current generator 16 generates a second current. Here, in FIG. 1, the second current generator 16 generates a current based upon the first current generated by the first current generator 12. As will be described in relation to the figures that follow, the second current generator 16 generates a second current that decreases in relation to increases in temperature and in the first current and, conversely, increases in relation to decreases in the first current.

A second current mirror 18 generates a second mirrored current based on the second current generated by the second current generator 16. The second mirrored current produced by the second current mirror 18 is added to the first mirrored current produced by the first current mirror 14 at summing element 20. Because the first and second mirrored currents respond in an inverse manner, the sum of the first and second mirrored current will be substantially constant if the current mirrors are scaled appropriately to vary in the same amount based on changes to the first current. The second mirrored current has a temperature response that is opposite of the first mirrored current. Accordingly, adding the two mirrored currents results in a substantially flat current response over a temperature change.

A third current mirror 22 generates a reference current based on a sum of the first and second mirrored currents. Because the sum of the first and second mirrored currents are substantially constant, and because the sum is being used as a reference current for the third current mirror, the output of the third current mirror 22 is a constant reference current. It should be understood that "constant" should be interpreted to mean substantially constant in relation to changes in the first current that are due to loading and/or device temperature changes. For extreme changes in device temperature, the first current can vary by as much as 20 percent. The embodiment described here can result in changes in the reference current being limited to a much lower amount such as 2 percent.

Figure 2:
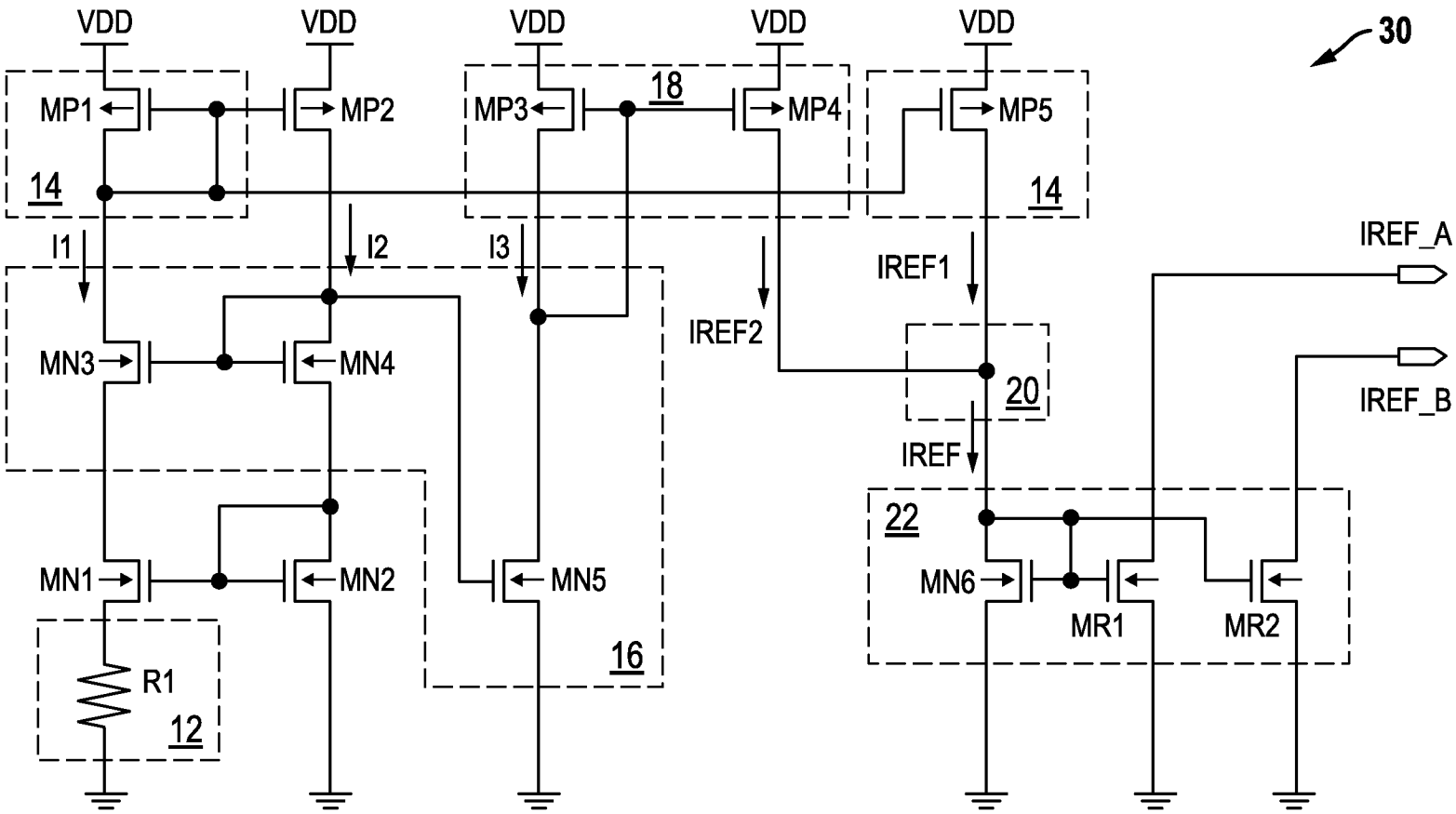
FIG. 2 is a schematic diagram of a circuit for generating a constant current source according to one embodiment.

FIG. 2 is a schematic diagram of a circuit for generating a constant current source according to one embodiment. As may be seen, a MOSFET MP1 has a source terminal connected to a supply, a drain terminal connected to a drain terminal of a MOSFET MN3 and a gate terminal connected to a gate terminal of a MOSFET MP2. A source terminal of MOSFET MP2 is connected to the supply. MOSFET MP1 is a P-channel MOSFET. MOSFET MN3 is an N-channel MOSFET. The source terminal of MOSFET MN3 is connected to a drain terminal of MOSFET MN1. A source terminal of MOSFET MN1 is connected to a resistor R1 that is also connected to ground. A gate terminal of MOSFET MN3 is connected to a gate terminal of MOSFET MN4 while a gate terminal of MOSFET MN1 is connected to a gate terminal of MOSFET MN2. Additionally, the gate and drain terminals of MOSFET MP1 are connected to each other as a part of the current mirror configuration. Similarly, the gate and drain terminals of MOSFET MN4 are connected to each other. Additionally, the gate and drain terminals of MOSFET MN2 connected to each other.

A source terminal of MOSFET MP3 is connected to the supply while a drain terminal is connected to a drain terminal of a MOSFET MN5. A source terminal of MOSFET MN5 is connected to ground. MOSFET MP3 is a P-channel MOSFET while MOSFET MN5 is an N-channel MOSFET. A gate terminal of MOSFET MN5 is connected to the drain terminal of MOSFET MN4. A gate terminal of MOSFET MP3 is connected to the drain terminal of MOSFET MP3 and to a gate terminal of MOSFET MP4. A source terminal of MOSFET MP4 is connected to the supply. A drain terminal of MOSFET MP4 is connected to a drain terminal of MOSFET MP5. A source terminal of MOSFET MP5 is connected to the supply and a gate terminal is connected to the drain terminal of MOSFET MP1. The drain terminal of MOSFET MP5 is also connected to a drain terminal of a N-channel MOSFET MN6 while the source terminal of MOSFET MN6 is connected to ground. A gate terminal of MOSFET MN6 is connected to the drain terminal of MOSFET MN6 as well as to the gate terminal of MOSFETs MR1 and MR2. The drain terminals of MOSFETs MR1 and MR2 are the output source terminals for the circuit while the source terminals are connected to ground. MOSFETs MN6, MR1 and MR2 are all N-channel MOSFETs.

Circuit elements of FIG. 2 that are a part of the blocks described in relation to FIG. 1 are illustrated within the dashed boxes. For example, resistor R1 primarily defines current I1 since the resistive value of resistor R1 is the primary factor that determines the current based on the supply VDD. Accordingly, in the described embodiment, the first current generator 12 comprises resistor R1. The first current mirror 14 comprises MOSFET's MP1 and MP5 wherein MOSFET MP1 conducts the reference current I1 and MOSFET MP5 generates the first mirrored current labeled as IREF1. Accordingly, both MOSFETs MP1 and MP5 have a dashed box labeled 14. MP1 conducts current I1 that increases with temperature increases and vice-versa.

For the formulas that follow, the following parameters are often used:

| | |
|---|---|
| $\mu_n$ | Mobility |
| $C_{OX}$ | Gate Oxide Capacitance |
| (W/L) | Width/Length Aspect Ratio |
| K | Sizing Proportion of $MN_1$ to $MN_2$ |
| R1 | Resistance Value |

Drain current in a MOSFET in the saturation region is given by Formula (A)

$$I=\tfrac{1}{2}\mu C_{OX}(W/L)*(V_{GS}-V_{TH})^2 \tag{A}$$

Generally, the current is a function of the mobility, the gate oxide film capacitance per unit area and the ratio of the width to the length of the device. The difference between the Gate-to-Source and Threshold voltages ($V_{TH}$) also affect the magnitude of the drain current. Moreover, $V_{TH}$ and $\mu$ decrease as temperature increases. Current I increases with temperature increases. The gate-to-source voltage $V_{GS}$ is defined as follows:

$$V_{GS}=\sqrt{\frac{2*I}{\mu C_{OX}(W/L)}}+V_{TH} \tag{B}$$

It should be understood that I1=I2 if MP1 and MP2 are sized equally and, additionally if the size ratio of MN1 and MN2 is K:1 (meaning MN1 and MN2 are not sized equally).

The current I1 is generated according to the following formula:

$$I1=\frac{2}{\mu_n C_{OX}(W/L)_{MN2}}*\left(\frac{1}{R1}\right)^2*\left(1-\frac{1}{\sqrt{K}}\right)^2 \tag{C}$$

Because $\mu$ and R1 decrease with temperature increases, I1 increases with temperature increases. In a general manufacturing process, for example, temperature characteristic of $\mu$ is proportional to $T^{-1.5}$ (T: absolute temperature) and temperature characteristic of resistor is approximately −80 ppm/degree. The second current generator 16 is shown to include MOSFETs MN3, MN4 and MN5. These three MOSFETs create the effect of having a reverse current characteristic with increases in temperature. Because MOSFET MN5 tends to constrict current flow for increases in the gate voltage that occur based on increases in current I1, MOSFET MN5 generates the reference current I3 for the second current mirror 18.

The current I3 is generated according to the following formula:

$$I3=\frac{(W/L)_{MN5}}{(W/L)_{MN2}}*\left(\frac{8}{C_{OX}\mu_n}*\left(\frac{1}{R1}\right)^2*\left(1-\frac{1}{\sqrt{K}}\right)^2+\frac{4}{R1}*\left(1-\frac{1}{\sqrt{K}}\right)\right)+\frac{1}{2}\mu_n*C_{OX}*(W/L)_{MN5}*(V_{TH})^2 \tag{D}$$

MOSFET MP4 generates the second mirrored current based on the reference current I3. The second mirrored current is shown as IREF2. It may be seen, therefore, that reference current I3 decreases for increases in reference current I1 and vice versa. With proper scaling, changes in IREF2 are equal in magnitude go opposite of changes in IREF1. Accordingly, current IREF maintains a substantially constant value. Current IREF then is the reference current for the third current mirror 22 that generates the constant output reference currents. In a general manufacturing process, for example, temperature characteristic of μ is proportional to $T^{-1.5}$ (T: absolute temperature) and temperature characteristic of resistor is approximately −80 ppm/degree. Furthermore, $V_{TH}$ appears in this formula and is squared. Temperature characteristic of $V_{TH}$ is approximately −3000 ppm/degree and extremely large. With this, the current I3 decreases with temperature increase. In addition, I3 decreases more by making an aspect ratio of MN5 small (less than 1).

If MN2 and MN4 are equally sized $$V_{GS(MN5)} = 2 * \sqrt{\frac{2 * I_2}{\mu C_{OX}(W/L)_{MN2}}} + 2 * V_{TH} \tag{E}$$

Formula (E) illustrates the calculation for $V_{GS}$. $V_{GS}$ varies with $I_2$ and the physical dimensions of MN2.

I2=I1 if MP1 and MP2 are equally sized $$I2 = I1 = \frac{2}{\mu_n * C_{OX} * (W/L)_{MN2}} * \left(\frac{1}{R1}\right)^2 * \left(1 - \frac{1}{\sqrt{K}}\right)^2 \tag{F}$$

If I2 is substituted $$V_{GS(MN5)} = 2 * \sqrt{\frac{2 * I2}{\mu_n * C_{OX} * (W/L)_{MN2}}} + 2 * V_{TH} \tag{G}$$

$$V_{GS(MN5)} = \frac{2}{\mu_n * C_{OX} * (W/L)_{MN2}} * \left(\frac{1}{R1}\right) * \left(1 - \frac{1}{\sqrt{K}}\right) + 2 * V_{TH} \tag{H}$$

If $V_{GS}$MN5 is substituted $$I3 = \frac{1}{2} * \mu_n * C_{OX} * (W/L)_{MN5}\left[\frac{2}{\mu_n * C_{OX} * (W/L)_{MN2}} * \left(\frac{1}{R1}\right) * \left(1 - \frac{1}{\sqrt{K}}\right) + V_{TH}\right]^2 \tag{I}$$

$$I3 = \frac{(W/L)_{MN5}}{(W/L)_{MN2}}\left[\frac{8}{\mu_n * C_{OX}} * \left(\frac{1}{R1}\right)^2 * \left(1 - \frac{1}{\sqrt{K}}\right)^2 + \left(\frac{4}{R1}\right) * \left(1 - \frac{1}{\sqrt{K}}\right)\right] + \frac{1}{2} * \mu_n * C_{OX} * (W/L)_{MN5} * V_{TH}^2 \tag{J}$$

The Formulas (F)-(J) illustrate derivation for I3.

The current IREF1 is generated according to the following formula:

$$IREF1 = I1 * \frac{(W/L)_{MP5}}{(W/L)_{MP1}} \tag{K}$$

As may be seen from Formula (K), if MP1 and MP5 are equally sized, IREF1 is equal to I1. Similarly, the current IREF2 is generated according to the following formula:

$$IREF2 = I3 * \frac{(W/L)_{MP4}}{(W/L)_{MP3}} \tag{L}$$

Similar to the case for IREF1, if MP3 and MP4 are equally sized, IREF2 is equal to I3. Accordingly, the current IREF is generated according to the following formula:

$$IREF = IREF1 + IREF2 \tag{M}$$

Figure 3:
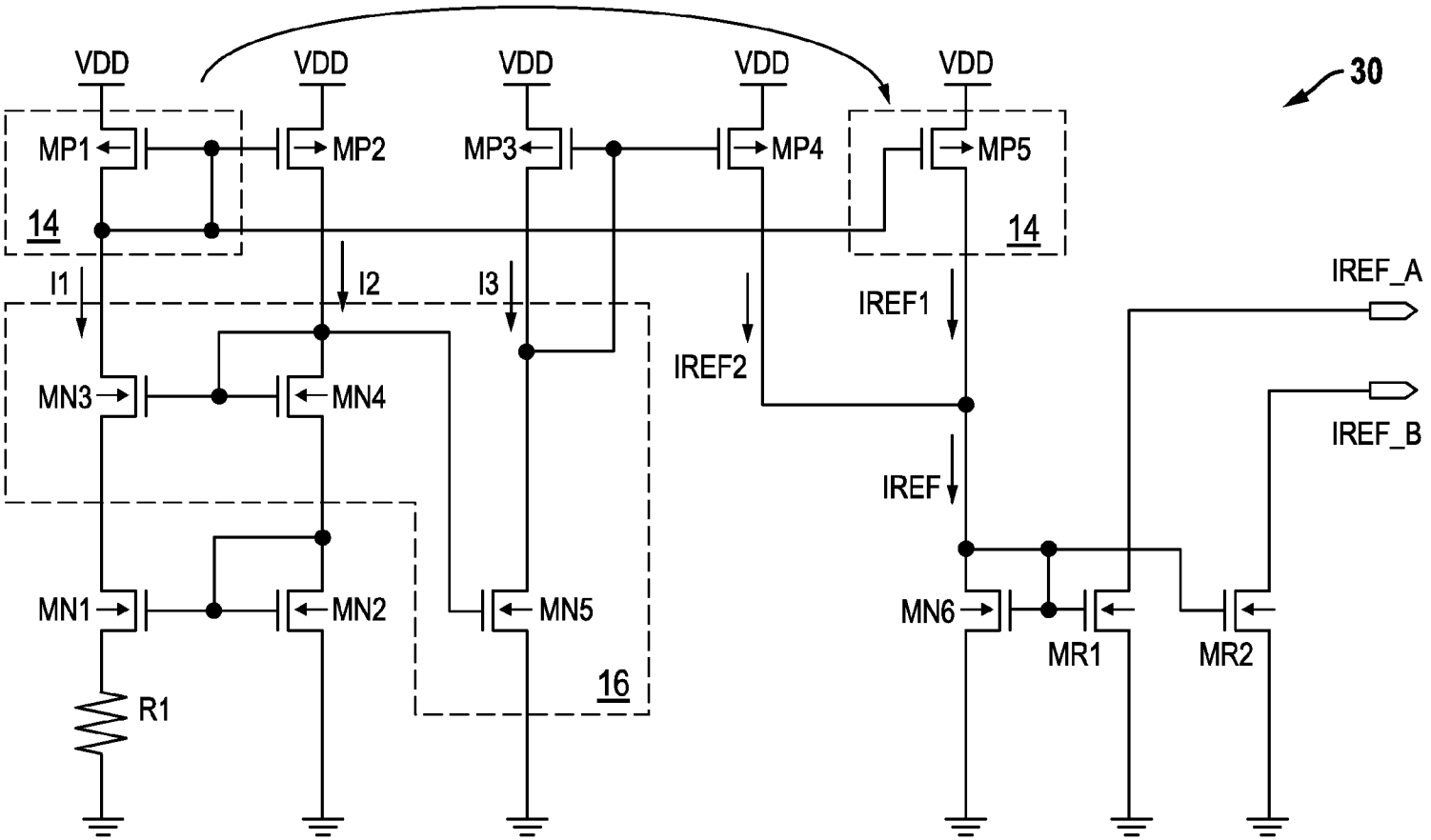
FIGS. 3 and 4 are schematic diagrams illustrate the cooperative relationship between various devices.
Figure 4:
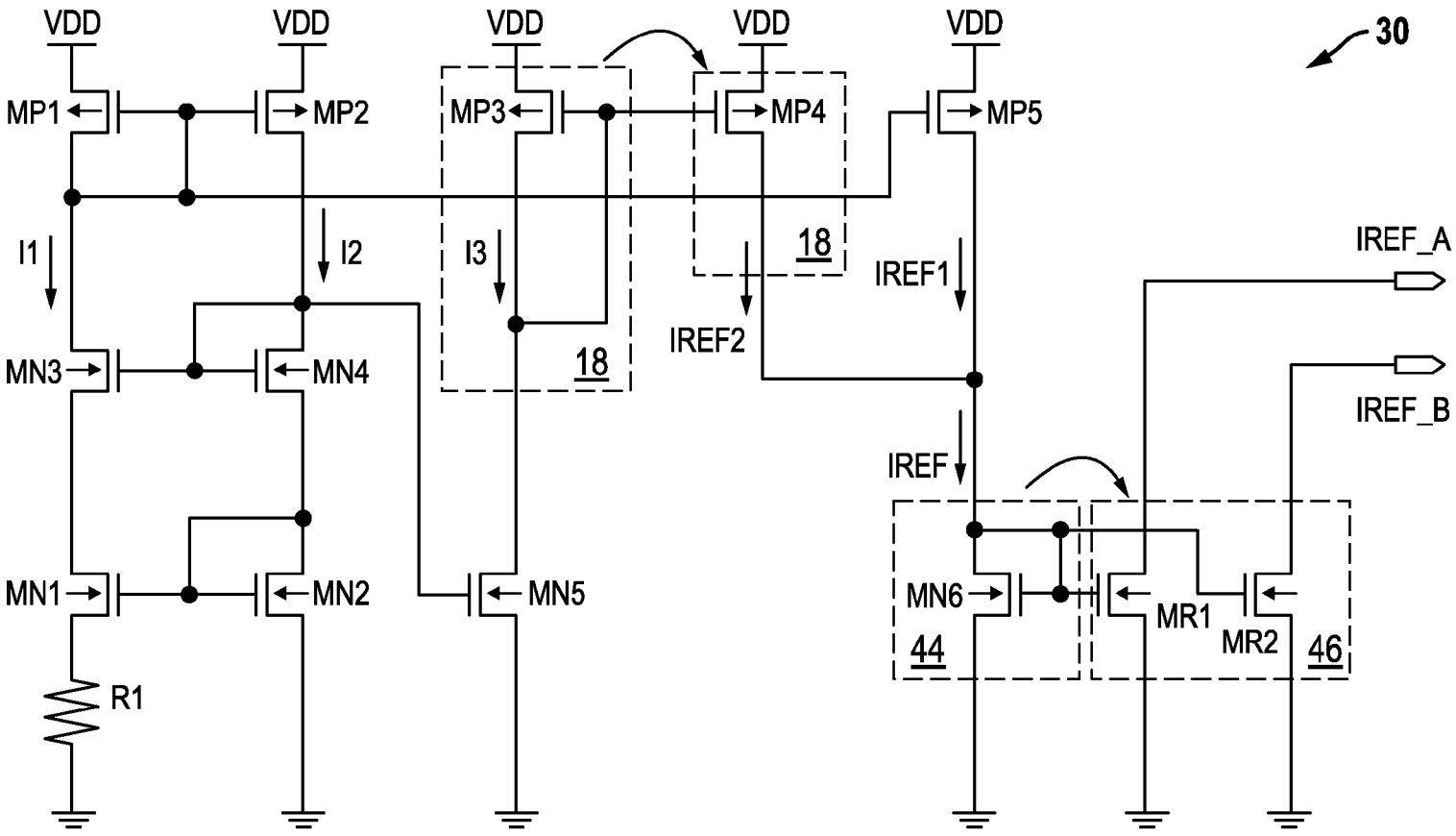

FIGS. 3 and 4 are schematic diagrams that are the same as FIG. 2 and illustrate the cooperative relationship between various devices. Referring to FIG. 3, it may be seen that the first current mirror 14 includes MOSFETs MP1 and MP5 and that MOSFET MP5 generates the first mirrored current IREF1 based on the reference current I1. The magnitude of reference currents I1 is a function of the resistive value of resistor R1, the scaling of the components, the supply voltage VDD magnitude and the effects of temperature changes. FIG. 3 also identifies the second current generator 16 that helps define current I3 and IREF2. Each of these currents may be better understood in the preceding discussions and formulas.

Referring to FIG. 4, it may be seen that the second current mirror 18 is represented by two dashed boxes that include MOSFETs MP3 and MP4. MOSFET MP3 conducts the reference current I3 while MOSFET MP4 generates the second mirrored current IREF2. As described before, I3 decreases as temperature increases thereby causing IREF2 to decrease. I3 and IREF2 increase with temperature decreases.

Figure 5:
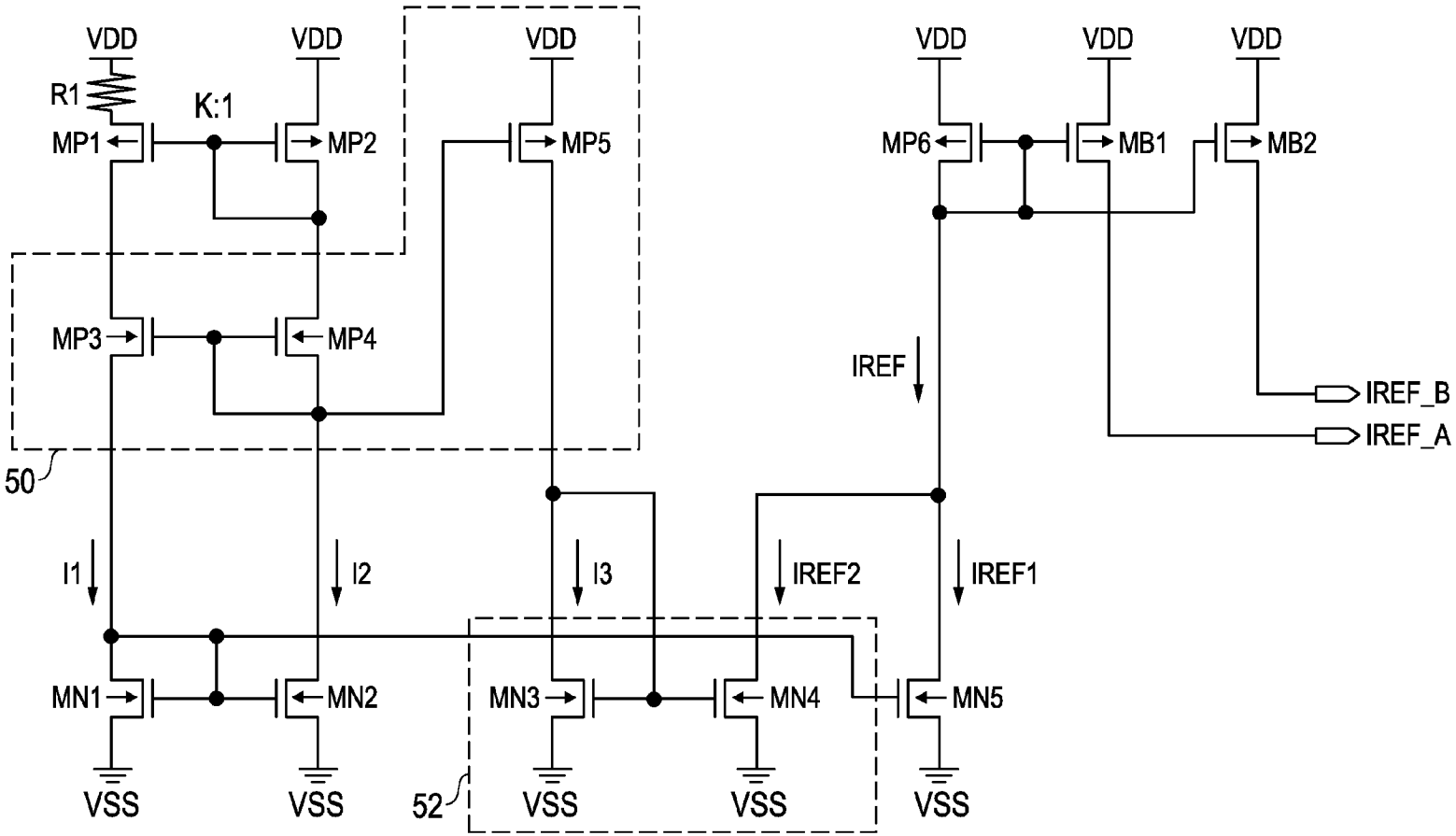
FIG. 5 is a schematic diagram of a circuit according to one alternative embodiment that reduces current flow for increases in temperature.

FIG. 5 is a schematic diagram of a circuit according to one alternative embodiment that reduces current flow for increases in temperature. The circuitry shown within dashed box 50 is a current generator circuit that has a reverse current magnitude characteristic in relation to temperature. The current decreases with temperature increases and vice-versa. The dashed box 52 includes current circuitry that generates the mirrored current based on the current generated by the current generator 50. The transistors here may be configured to have a cascode connection to support precise current mirror characteristics. In one embodiment, the circuit may be configured to include P-Channel MOSFETs. A start up circuit may also be added to create stability at the outset of circuit operation.

Figure 6:
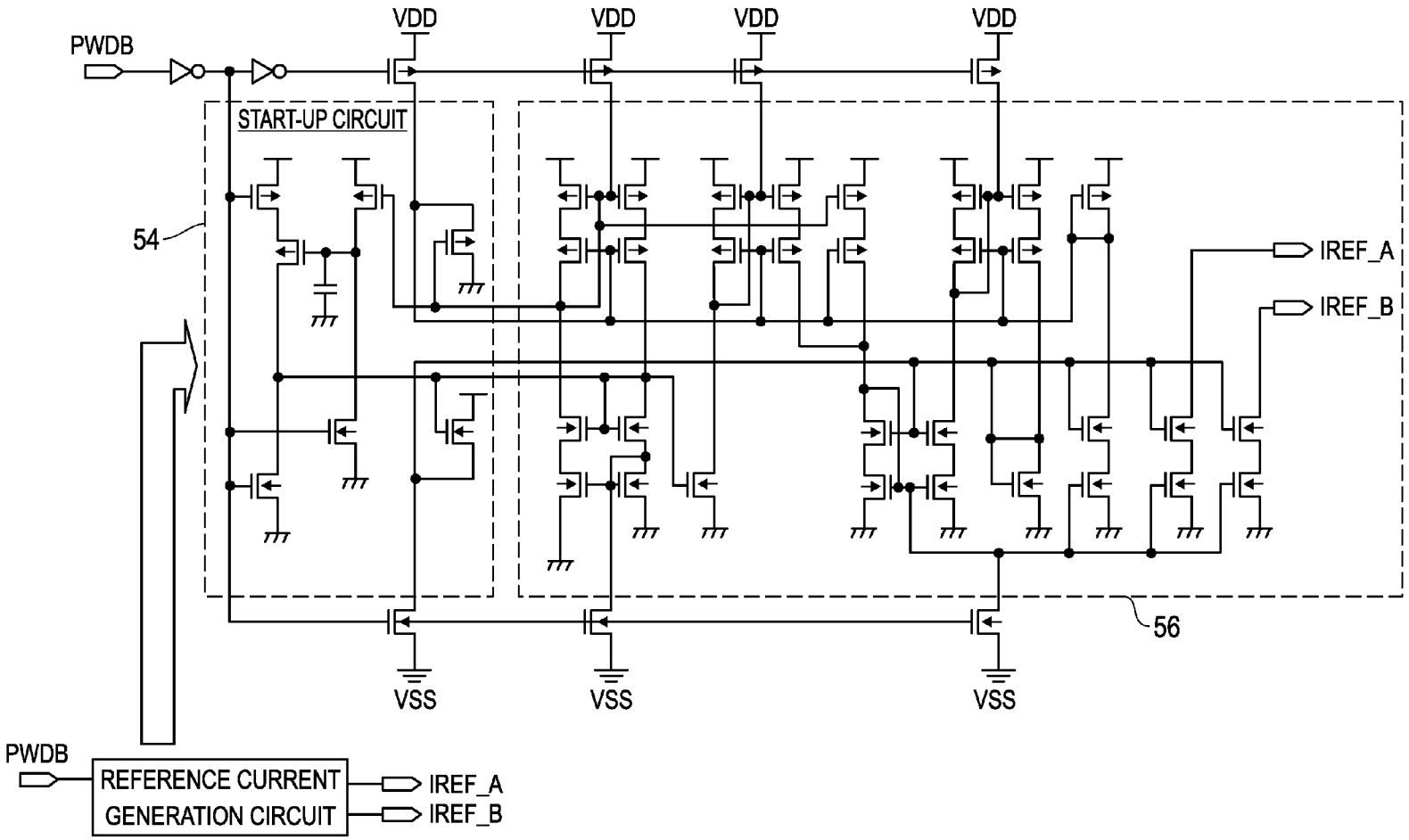
FIG. 6 is a schematic diagram of a circuit according to at least one embodiment that includes a start up circuit to create stability at the outset of circuit operations.

FIG. 6 is a schematic diagram of a circuit according to at least one embodiment that includes a start up circuit to create stability at the outset of circuit operations. More specifically, the circuitry within box 54 represents the startup circuitry while the circuitry within box 56 represents one embodiment of the feed-forward circuitry described herein.

Figure 7A:
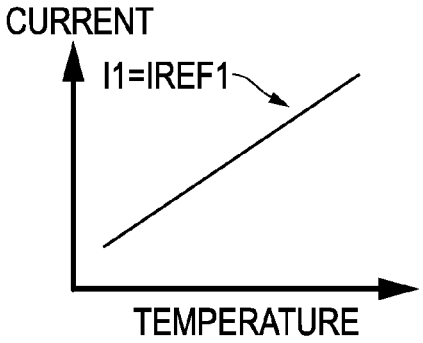
FIGS. 7*a*-7*c* are graphs that illustrate a relationship between temperature and current for several different currents in the circuits according to the various embodiments.
Figure 7B:
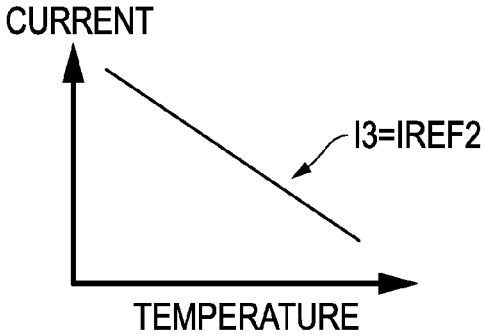
Figure 7C:
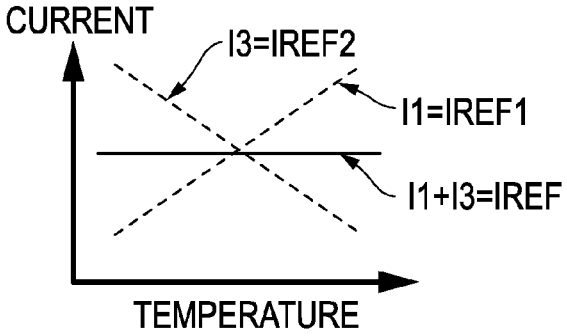

FIGS. 7*a*-7*c* are graphs that illustrate a relationship between temperature and current for several different currents in the circuits according to the various embodiments. Referring to FIG. 7*a*, a relationship between I1, IREF1 and temperature is shown. As may be seen, I1 increases with increases in temperature. Accordingly, because of current mirror topology as described previously, IREF1 mirrors I1 and also increases with temperature. Referring to FIG. 7*b*, I3 decreases inversely with increases in temperature. Accordingly, because of current mirror topology as described previously, IREF2 mirrors I3 and also decreases inversely with temperature. Referring to FIG. 7*c*, IREF1 and IREF2 are shown in dashed lines. According to the described embodiments, the circuitry is configured to sum IREF1 and IREF2 to create IREF. IREF is the equivalent of I1+I3=IREF1+IREF2. As may be seen, IREF is shown as a flat line meaning that IREF remains constant across changing temperatures. In reality, according to circuit implementation and device tolerances, an actual response curve for IREF may not be completely flat or constant but may be substantially flat or constant. In a worst case, IREF may increase or decrease up to 10 percent in relation to changes of either I1 or I3.

Figure 8:
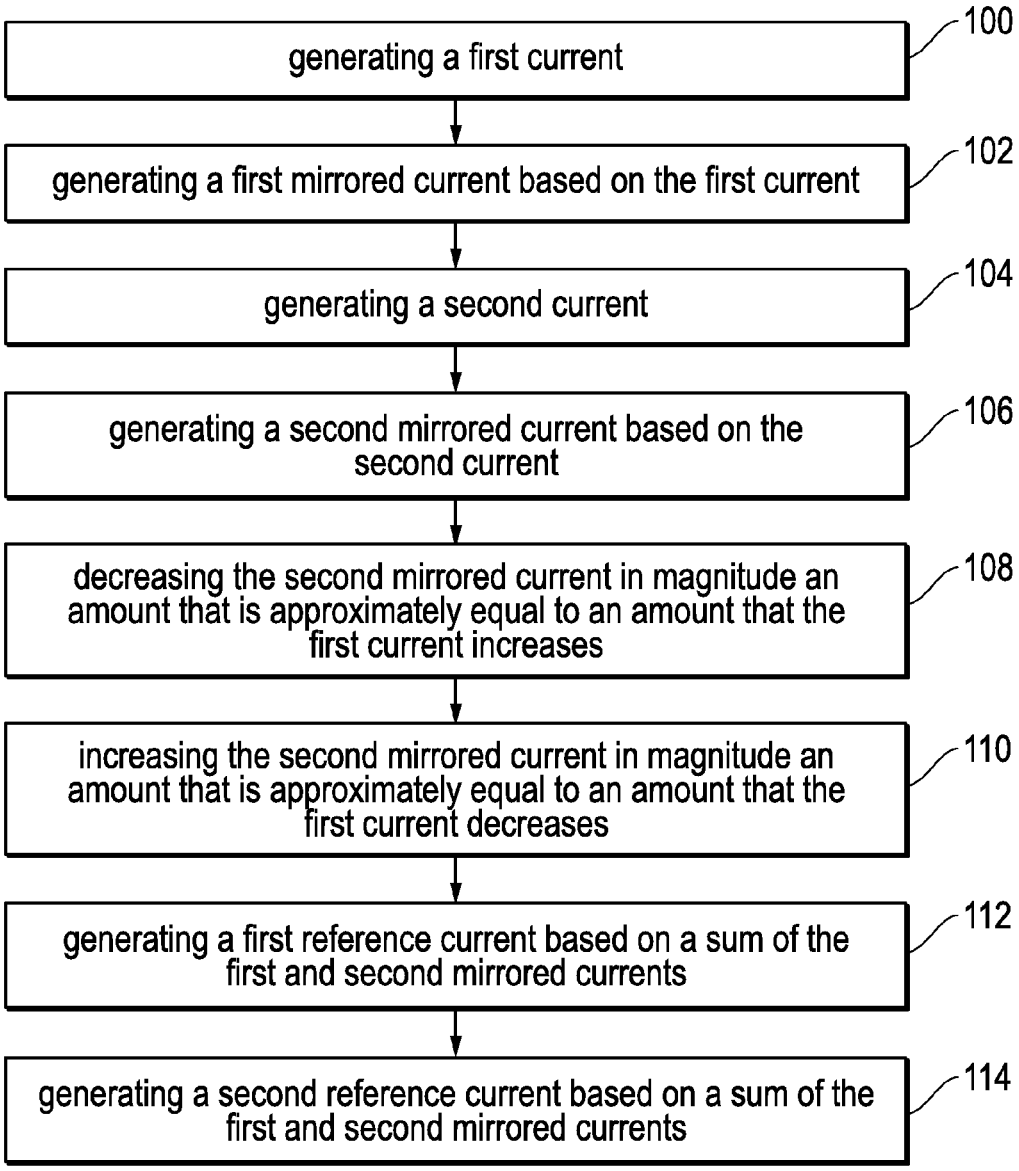
FIG. 8 is a flowchart that illustrates a method according to one embodiment.

FIG. 8 is a flowchart that illustrates a method according to one embodiment. The method includes generating a first current (100) and generating a first mirrored current based on the first current (102). In one embodiment, the first current is primarily determined by a resistive element as shown in FIGS. 2-4. This first current is generated by first current generator 12 in one embodiment. The first mirrored current is the current IREF1 described before. Thereafter, the method includes generating a second current (104) by a second current generator. In the described embodiment, the second current generator 16 generates a current that decreases as the first current increases and vice versa. The method further includes generating a second mirrored current based on the second current (106).

As described, before the second mirrored current decreases in magnitude in response to an increase in the first current which, for example, may be due to temperature increases. Conversely, the second mirrored current increases in magnitude in response to a decrease in the first current. This may be due to a temperature decrease. Accordingly, the method includes decreasing the second mirrored current in a magnitude that is approximately equal to a magnitude of a first current increase (108) or, alternatively, increasing the second mirrored current in a magnitude that is approximately equal to a magnitude of a first current decrease (110). Thereafter, the method includes generating a first reference current based upon the sum of the first and second mirrored currents (112). The method also includes generating a second reference current based upon the sum of the first and second mirrored currents (114).

The above-disclosed subject matter is to be considered illustrative, and not restrictive, and the appended claims are intended to cover all such modifications, enhancements, and other embodiments that fall within the true scope of the claims. Thus, to the maximum extent allowed by law, the scope of the present invention is to be determined by the broadest permissible interpretation of the following claims and their equivalents, and shall not be restricted or limited by the foregoing detailed description.

What is claimed is:

1. A circuit for generating a constant current, comprising:
- a first current generator that conducts a first current based upon a supply voltage and a resistive element;
- a second current generator that generates a second current based on the first current wherein the second current decreases as the first current increases and increases as the first current decreases;
- a summing circuit for summing currents proportional to said first and second currents to generate an output current, wherein the summing circuit comprises:
  - a first current mirror for providing a first mirrored current proportional to the first current;
  - a second current mirror for providing a second mirrored current proportional to the second current; and
  - a summing device for summing the first and second mirrored currents to provide a first reference current, and
- a third current mirror for providing a second reference current proportional to the first reference current.

2. The circuit for generating the constant current of claim 1 wherein the second reference current changes approximately 10% or less in relation to changes in the first current due to either loading or circuit temperature changes.

3. The circuit for generating the constant current of claim 1 wherein the first current and a resistance of the resistive element increase with temperature increases.

4. The circuit for generating the constant current of claim 3 wherein the first current and the resistance of the resistive element increase as much as 20% with temperature increases.

5. The circuit for generating the constant current of claim 1 wherein the second reference current changes no more than 2% for a 20% change in the first current due to temperature changes.

6. The circuit for generating the constant current of claim 1 wherein the second mirrored current decreases as a circuit temperature increases.

7. The circuit for generating the constant current of claim 1 wherein the first current mirror uses n-channel MOSFETs and the third current mirror uses p-channel MOSFETs or the first current mirror uses p-channel MOSFETs and the third current mirror uses n-channel MOSFETs.

8. The circuit for generating the constant current of claim 7 wherein the second current mirror uses the same type of MOSFETs as the first current mirror.

9. The circuit for generating the constant current of claim 1 wherein the third current mirror comprises at least two MOSFETs that generate two constant current source outputs based on the sum of the first and second mirrored currents.

10. A system for generating a constant reference current, comprising:
- a first current generator configured to generate a first current;
- a first current mirror that generates a first mirrored current based on the first current;
- a second current generator that generates a second current;
- a second current mirror that generates a second mirrored current based on the second current; and
- a third current mirror that generates a reference current based on a sum of the first and second mirrored currents.

11. The system of claim 10 wherein the second current generator is configured to decrease a magnitude of the second current based upon at least one of an increase in temperature and an increase in the first current.

12. The system of claim 11 wherein the second current generator decreases the second current based on increases in the first current and, inversely, increases the second current based on decreases in the first current.

13. A method in a circuit configured for generating a substantially constant reference current course, comprising:
- generating a first current;
- generating a first mirrored current proportional to the first current;
- generating a second current based on the first current, wherein the second current decreases as the first current increases and increases as the first current decreases;
- generating a second mirrored current proportional to the second current;
- generating a first reference current proportional to a sum of the first and second mirrored currents; and
- generating a second reference current proportional to the first reference current.

14. The method of claim 13 further including decreasing the second current based upon an increase in temperature.

15. The method of claim 13 further including decreasing the second mirrored current based on increases in the first current and, inversely, increasing the second mirrored current based upon decreases in the first current.

16. The method of claim 13 wherein the reference current changes no more than 10 percent in relation to changes in the first current.

17. The method of claim 13 further including generating the first current based upon a voltage and a current setting resistive element.

* * * * *